United States Patent [19]

Okayasu

[11] Patent Number: 4,811,501

[45] Date of Patent: Mar. 14, 1989

[54] FOOTWEAR

[75] Inventor: Kenji Okayasu, Gyoda, Japan

[73] Assignee: Rikio Co., Ltd., Gyoda, Japan

[21] Appl. No.: 71,933

[22] Filed: Jul. 10, 1987

[30] Foreign Application Priority Data

Jul. 10, 1986 [JP] Japan ..... 61-105976

[51] Int. Cl.[4] ..... A43B 7/26; A43C 13/14

[52] U.S. Cl. ..... 36/94; 36/77 R

[58] Field of Search ..... 36/94, 77 R, 72 R

[56] References Cited

U.S. PATENT DOCUMENTS

| | | | |
|---|---|---|---|
| 1,115,045 | 10/1914 | Werkheiser | 36/77 R |
| 2,111,536 | 3/1938 | Murray | 36/72 R |
| 2,625,753 | 1/1953 | Null et al. | 36/72 R |
| 3,013,564 | 12/1961 | Levey | 36/94 |
| 3,191,321 | 6/1965 | Brutting | 36/77 R |
| 3,206,874 | 9/1965 | Ellis et al. | 36/72 R |
| 3,995,382 | 12/1976 | Smith | 36/72 R |

FOREIGN PATENT DOCUMENTS

| | | | |
|---|---|---|---|
| 2828872 | 11/1979 | Fed. Rep. of Germany | 36/77 R |
| 28-9929 | 10/1953 | Japan . | |
| 30-16358 | 11/1955 | Japan . | |
| 44-585 | 1/1969 | Japan . | |
| 7811065 | 5/1979 | Netherlands | 36/77 R |
| 134742 | 11/1919 | United Kingdom | 36/72 R |
| 201437 | 8/1923 | United Kingdom | 36/72 R |

*Primary Examiner*—Steven N. Meyers

*Attorney, Agent, or Firm*—Fleit, Jacobson, Cohn & Price

[57] ABSTRACT

Footwear having a toe protector removably connected to the toe thereof to protect the toes of a foot from falling objects. The removable connection is achieved by fitting headed protrusions on the sole into apertures formed in the toe protector.

8 Claims, 3 Drawing Sheets

FOOTWEAR

FIELD OF THE INVENTION

This invention relates to footwear such as a rubber-soled "tabi", working shoes and the like, and more particularly, to safety footwear adapted to protect the toes of a foot from falling objects.

BACKGROUND OF THE INVENTION

Safety footwear has been known in Japanese Utility Model Publications Sho No. 28-9929 and Sho No. 30-16358 and comprises toe protector means positioned on the toe thereof and mounted on a member which is supported from a leg. Japanese Utility Model Publication Sho No. 44-585 discloses a safety shoe having a toe protector removably attached to the toe thereof by inserting a plurality of pins into aligned apertures in peripheral portions of the toe protector and the toe of the shoe. This arrangement makes it possible to provide safety shoe simpler than that of the above-mentioned types but there is the possibility of losing the pins by coming out of the apertures.

An object of the present invention is to provide a footwear having toe protector means removably attached to the toe thereof without any danger of losing pins.

This and other objects and features of the present invention will become more fully apparent from the following description and appended claims taken in conjunction with the accompanying drawings.

SUMMARY OF THE INVENTION

The object of the invention is achieved by providing a working footwear including an upper and a sole and having a toe protector means arranged to cover the toe of the upper, characterized in that the sole has a raised portion at the periphery of the toe thereof, the raised portion is provided with a plurality of outwardly extending headed protrusions formed integrally therewith, and the toe protector means has a plurality of corresponding apertures formed therein for receiving the headed protrusions to connect the toe protector means to the raised portion of the sole.

The footwear may comprise a rubber-soled "tabi" having a big toe portion and remaining toes portion or conventional working shoes. In the former case, the toe protector means comprises two toe protectors used for these portions of the rubber-soled "tabi".

BRIEF DESCRIPTION OF THE DRAWINGS

For a more complete understanding of this invention, reference should now be made to the embodiments illustrated in detail in the accompanying drawings. In the drawings.

DETAILED DESCRIPTION OF THE PREFERRED EMBODIMENT

Figure 1:
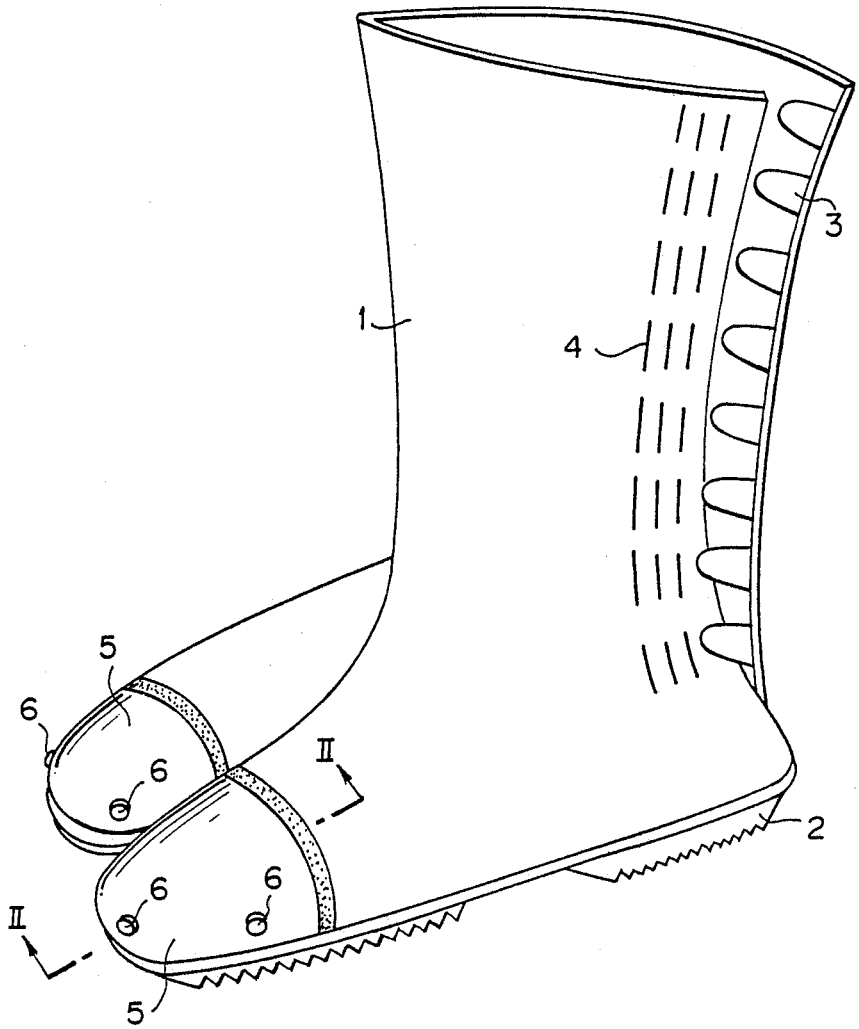
FIG. 1 is a perspective view of a rubber-soled "tabi" having toe protectors attached to big toe and remaining toes portions thereof.

Referring to the drawings wherein like parts are given the same reference numeral, the footwear according to the invention comprises a rubber-soled "tabi" having an upper 1 and a sole 2. A split portion of the upper 1 defining an opening clasps 3 secured thereto at one of the edges and strings 4 attached to the upper porition along the other edge to fasten the clasps 3. The rubber-soled "tabi"includes big toe and remaining toes portions of the upper 1. In each of the big toe and remaining toes portions, the sole is provided with a raised portion at the sole periphery and having a plurality of outwardly extending headed protrusions 6 formed integrally with the raised portion. There are provided toe protectors 5 arranged to cover each of the big toe and remaining toes portions of the upper 1. Each if the toe protectors 5 are provided with apertures 7 formed therein to receive the headed protrusions 6, thereby removably connecting the toe protector to the sole portion. The inner surface of the toe protector 5 may be lined with any suitable cushion material 8 to avoid any damage to the upper 1 which would occur due to contact of the toe protector with the portion of the upper 1.

It will be noted that the headed protrusions 6 have enough elasticity to deform due to the fact that they are formed as integral elements of the sole 2 of elastomeric material. The toe protector 5 is positioned on the each of the big toe and remaining toes portions of the upper and then connected to the sole 2 by inserting the headed protrusions 6 into the apertures 7 in the toe protectors 5. During the insertion, the headed protrusions 6 are elastically deformed so as to enable the heads to pass through the apertures 7 and after passage, closely fit in the apertures 7 without any clearance therebetween so that the toe protector 5 is not incidentally disconnected from the toe of the rubber-soled "tabi" in use. Thus, the toe protectors 5 on the rubber-soled "tabi" effectively protect the toes of a foot from being injured by objects falling thereon. In a site where there is no danger that the objects fall, the toe protectors 5 can be removed frm the rubber-soled "tabi" prior to its wear.

Figure 2:
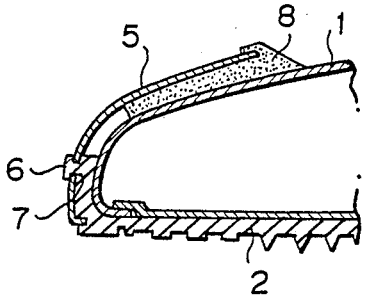
FIG. 2 is an elevational longitudinal section view of the big toe portion of the rubber-soled "tabi" taken along line II—II of FIG. 1.
Figure 3:
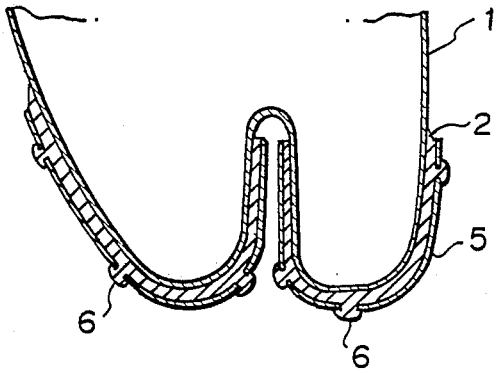
FIG. 3 is a horizontal section view of the toe of the rubber-soled "tabi"
Figure 4:
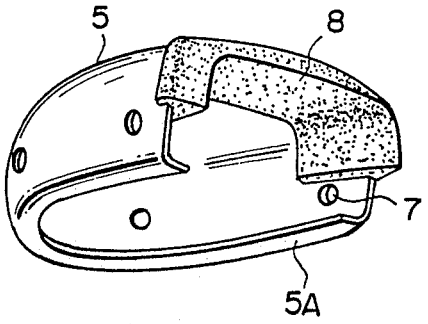
FIG. 4 is a perspective view of the toe protector for the big toe portion of the rubber-soled "tabi"

The toe protectors 5 may be made of metal or synthetic resin material and each provided with a inwardly horizontally extending flange 5A at the lower edge thereof, as shown in FIG. 4. As can be seen in FIG. 2, the flange 5A is fitted in a groove formed in the sole at the toe to provide better stability of the toe protector on the footwear.

Figure 5:
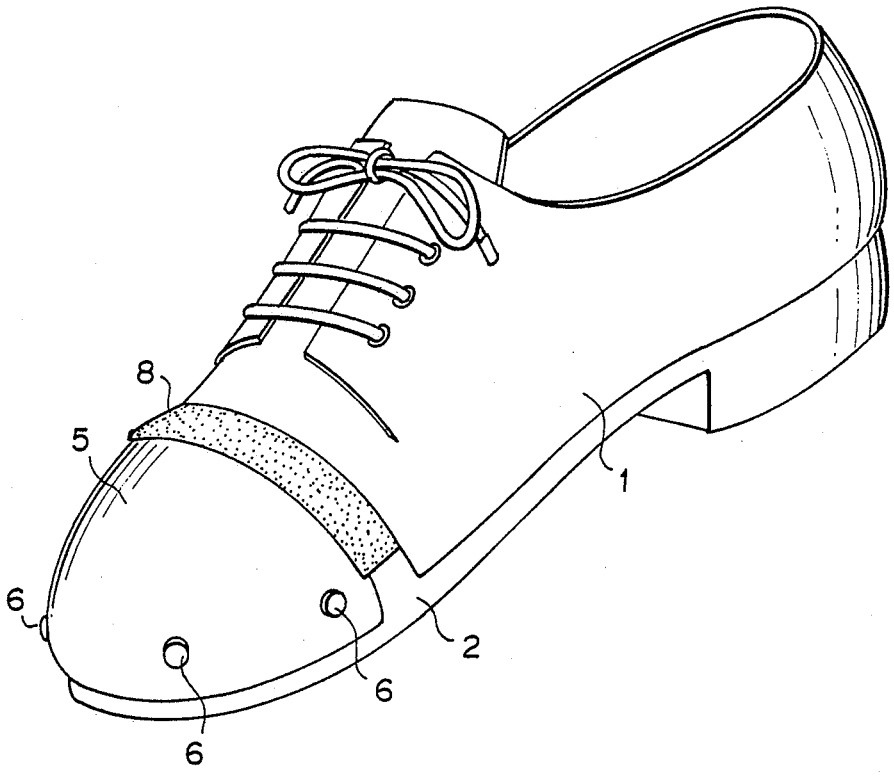
FIG. 5 is a perspective view of a working shoe having a toe protector attached to the toe thereof in the same manner as in FIG. 1 to 4.

Referring to FIG. 5, there is shown a working shoe having a toe protector 5 removably connected to the toe of the upper in the same manner as in the embodiment of the invention as described with reference to FIGS. 1 to 4 of the drawings.

What is claimed is:

1. Working footwear comprising:

an upper, a sole, toe protector means covering the toe of said upper, said sole having a raised portion at the periphery of the toe, the said raised portion including a plurality of outwardly extending protrusions formed integrally therewith, said protrusions including a head portion of a greater diameter than a shaft portion connecting said head portion with said raised portion, and said toe protector means having a plurality of apertures formed therein for receiving said protrusions therethrough and to receive said shaft portion therein to connect said toe protector means to said raised portion of said sole.

2. Working footwear as claimed in claim 1, wherein said upper and said sole include a big toe and remaining toe portions, and said toe protector means includes toe protectors each arranged to cover each of said big toe and said remaining toe portions.

3. Working footwear as claimed in claim 1, wherein said upper and said sole include a single toe portion, and said toe protector means includes a single toe protector arranged to cover said single toe portion.

4. Working footwear comprising:

an upper, a sole having a raised portion located at the toe and integrally including outwardly extending protrusions located at said raised portion and a groove formed at said raised portion, and toe protector means for protecting the toes of a wearer of the footwear, said toe protector including apertures corresponding in location to said protrusions for receiving said protrusions therethrough and an inwardly extending flange at a lower edge thereof for positioning within said groove to connect said toe protector means to said raised portion.

5. Working footwear as in claim 4, wherein said sole is elastically deformable.

6. Working footwear as in claim 4, wherein said protrusions include a head portion of a greater diameter than a shaft portion connecting said head portion with said raised portion.

7. Working footwear, comprising:

an upper, a sole having a raised portion located at the toe and integrally including outwardly extending protrusions located at said raised portion and a groove formed at said raised portion, said protrusions including a head portion of a greater diameter than a shaft portion connecting said head portion with said raised portion, and toe protector means for protecting the toes of a wearer of the footwear, said toe protector including apertures of a diameter substantially equal to a diameter of said shaft portion and corresponding in location to said protrusions for receiving said head portion therethrough and closely fitting around said shaft portion and an inwardly extending flange at a lower edge thereof for positioning within said groove to connect said toe protector to said raised portion.

8. Working footwear as in claim 7, wherein said sole is elastically deformable.

* * * * *